United States Patent [19]

Duncan

[11] 3,978,982

[45] Sept. 7, 1976

[54] FORM-FITTING SHIPPING CONTAINER

[75] Inventor: Richard K. Duncan, Lithonia, Ga.

[73] Assignee: The Mead Corporation, Dayton, Ohio

[22] Filed: Dec. 9, 1974

[21] Appl. No.: 530,509

[52] U.S. Cl. ..... 206/326; 206/491

[51] Int. Cl.[2] ..... B65D 85/54

[58] Field of Search ..... 206/314, 319–320, 206/326, 335, 386, 491, 521; 229/8, 16 R, 6 R

[56] References Cited

UNITED STATES PATENTS

| | | | |
|---|---|---|---|
| 471,043 | 3/1892 | Webb | 206/314 X |
| 1,188,825 | 6/1916 | Potter | 206/326 X |
| 2,313,362 | 3/1943 | Rous | 206/326 |
| 2,346,003 | 4/1944 | Bishop | 206/326 |
| 2,832,525 | 4/1958 | Cavin | 206/326 X |

*Primary Examiner*—William Price
*Assistant Examiner*—Steven E. Lipman
*Attorney, Agent, or Firm*—Erwin Doerr

[57] ABSTRACT

A form-fitting shipping container formed from a single blank of generally rectangular outline and particularly suited for the shipping and storing of upholstered furniture. As used for upholstered chairs of the type having a relatively low seat and a backrest, the container comprises an intermediate horizontal wall overlying a front portion of the chair, a horizontal top wall extending over the top of the backrest, and an inclined upper front wall extending between the mentioned intermediate horizontal wall and top wall. The container is reinforced at areas of increased stress by integral reinforcing elements providing a multi-ply construction of the inclined upper front wall and preferably also of the intermediate horizontal wall and top wall. In a preferred embodiment, the intermediate horizontal wall and the top wall are of the same size so that stacking of like containers in inverted relation with each other is facilitated and a compact and stable assembly is obtained.

9 Claims, 4 Drawing Figures

FORM-FITTING SHIPPING CONTAINER

This invention relates to shipping containers formed from a blank of paperboard, preferably corrugated board, and more specifically, to form-fitting containers used for shipping and storing upholstered furniture such as upholstered chairs.

A variety of shipping containers for furniture, including upholstered furniture such as chairs, is shown in the prior art. Typical examples are found in the U.S. patents to Nickerson No. 1,686,834, Rous No. 2,313,362, Bishop No. 2,346,003, Gibbons No. 2,675,955, and Cavin No. 2,832,525. While of the form-fitting type, the arrangements shown therein have serious disadvantages insofar as they are constructed from two or more separate blank components. For this reason, a considerable amount of labor, besides auxiliary equipment, is required for assembly. Furthermore, a large number of staples is needed for joining the various components together which may result in injury to the upholstery and unskilled personnel during the packaging or unpacking operation. Moreover, as the various container-forming components are frequently of irregular shape, considerable waste of material is experienced in the preparation of the blanks. In addition, since the components are of different sizes and shapes, the keeping of the inventory is unduly complicated.

An object of the present invention is to provide an arrangement which overcomes the disadvantages attendant with the prior art devices. More specifically, it is an object of the present invention to provide a form-fitting shipping container which is formed from a single unitary blank of generally rectangular outline. Another object is to provide a blank for such a container which is cut and scored on conventional box making equipment and which can be easily assembled. Still another object is to provide a construction which affords reinforcement in areas which are likely to be subjected to increased stress during handling and storage. Still another object is to provide a form-fitting container adapted to be stacked, in inverted relation, atop a like container so as to obtain a stable and compact assembly.

In general, the container of the present invention is of stepped configuration and is characterized by an inclined upper front wall extending between an intermediate horizontal wall and the top wall. An important feature resides in that integral reinforcing means are provided for reinforcing the mentioned inclined wall and preferably also the intermediate horizontal wall and top wall.

A preferred embodiment as used for an upholstered chair of the type having a relatively low seat, armrests and a backrest is illustrated in the accompanying drawing in which FIG. 1 is a perspective view of the partially assembled container;

Figure 1:
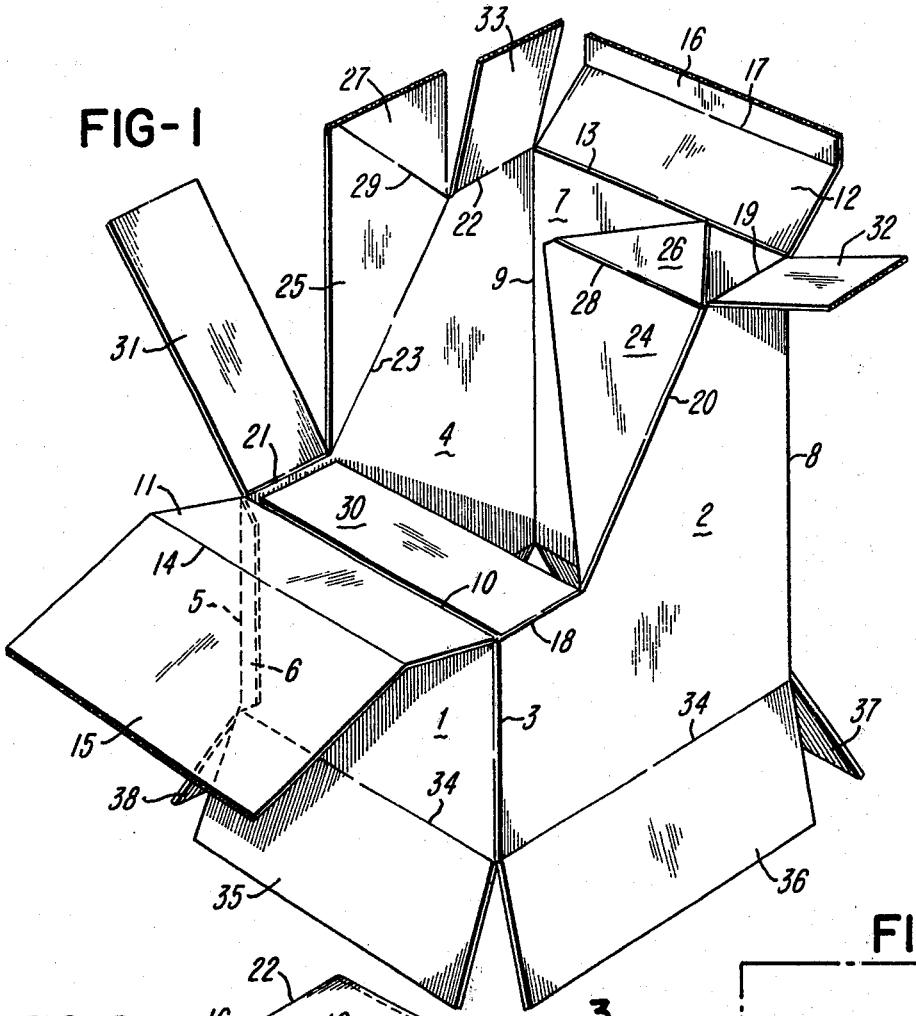

In the drawings, reference numeral 1 designates the lower front wall which corresponds in size approximately to the front end of the chair. Side wall 2 is foldably joined to lower front wall 1 along vertical fold line 3 while opposing side wall 4 is foldably joined to the other vertical edge 5 of lower front wall 1 by means of an attachment flap 6. Rear wall 7 is of a size corresponding approximately to the backrest of the chair and is foldably joined to the side walls 2 and 4 along vertical fold lines 8 and 9.

A relatively narrow intermediate horizontal wall 11 is foldably joined along the upper edge 10 of lower front wall 1 and extends inwardly to overlie the front portion of the chair. Similarly, a relatively narrow top wall 12 is provided along upper edge 13 of rear wall 7 and extends forwardly over the backrest of the chair. Integrally joined along the inner edge 14 of intermediate horizontal wall 11 is an inclined upper front wall 15 extending between the intermediate horizontal wall 11 and top wall 12. A front flap 16 is provided along the inner edge 17 of the top wall 12 and is disposed in coplanar abutting relationship with inclined upper front wall 15. The angle formed by the upper inclined front wall 15 with a horizontal line may vary, depending on the proportions of the chair and particularly the width of the backrest at its top. In many instances, an angle of inclination of about 45° is suitable, however, it may vary from about 30° to about 60°.

Side walls 2 and 4 conform to the stepped configuration defined by lower front wall 1, intermediate horizontal wall 11, inclined upper front wall 15 and top wall 12. Accordingly, the upper edge of side wall 2 is formed by an intermediate horizontal edge 18 extending adjacent intermediate horizontal wall 11 and coextensive therewith, an upper horizontal edge 19 adjacent top wall 12 and coextensive therewith, and an inclined edge 20 interconnecting the inner ends of intermediate horizontal edge 18 and upper horizontal edge 19, respectively. Likewise, the upper edge of side wall 4 is composed of an intermediate horizontal edge 21, an upper horizontal edge 22, and an inclined edge 23.

As one feature of the present invention, reinforcing means are provided at areas which are vulnerable or subject to increased stress. To this end, reinforcing panels 24 and 25 are provided along the inclined edges 20 and 23 of side walls 2 and 4, respectively, and are disposed in underlying face-contacting relationship with inclined upper front wall 15. For reasons of blank economy, these reinforcing panels 24 and 25 are of triangular configuration as shown but are preferably of such size that at least portions thereof overlap. To maintain the reinforcing panels 24 and 25 in their supporting position, stabilizing flaps 26 and 27 are provided in extension of reinforcing panels 24 and 25 and folded along horizontal fold lines 28 and 29, respectively, into mutually overlapping relation to underlie top wall 12.

Additional reinforcing means are provided in the form of flaps to strengthen the intermediate horizontal wall 11 and top wall 12. More specifically, flaps 30 and 31 are joined to side walls 2 and 4 along the intermediate horizontal edges 18 and 21, respectively, and folded into mutually overlapping relation to support the intermediate horizontal wall 11. Furthermore, top wall reinforcing flaps 32 and 33 are joined to the upper horizontal edges 19 and 22, respectively, and folded into superimposed relation with the aforementioned stabilizing flaps 26 and 27.

Figure 3:
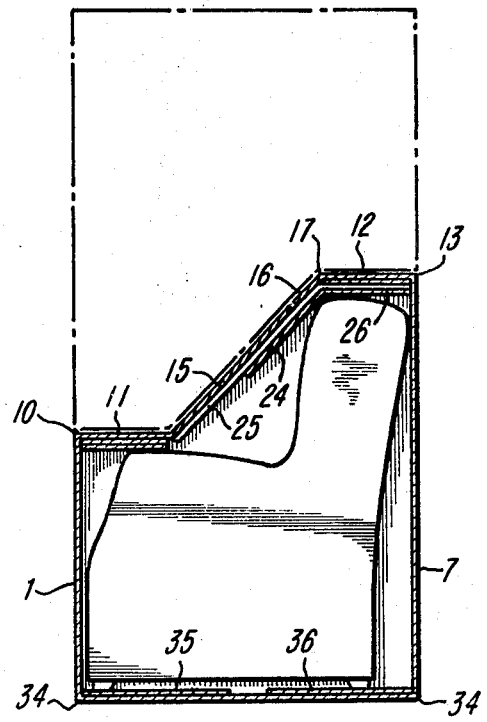
FIG. 3 is a cross-sectional view taken along line 3—3 of FIG. 2.

Intermediate horizontal wall 11 and top wall 12 are preferably of the same size. This permits like containers to be stacked in inverted relation with each other whereby the intermediate horizontal wall and top wall of the inverted container rest on the corresponding intermediate wall 11 and top wall 12 of a container below as indicated in phantom lines in FIG. 3. Since these load-bearing walls are reinforced as described above, injury to the content is prevented or minimized.

It may be observed here that arrangement of this invention affords a three-ply construction at the intermediate horizontal wall 11 and a substantially or at least partially three-ply construction at the inclined upper front wall 15 and top wall 12. Furthermore, attention is called to the fact that the mentioned reinforcing means are provided as integral elements of the blank as will be explained in the following.

Figure 4:
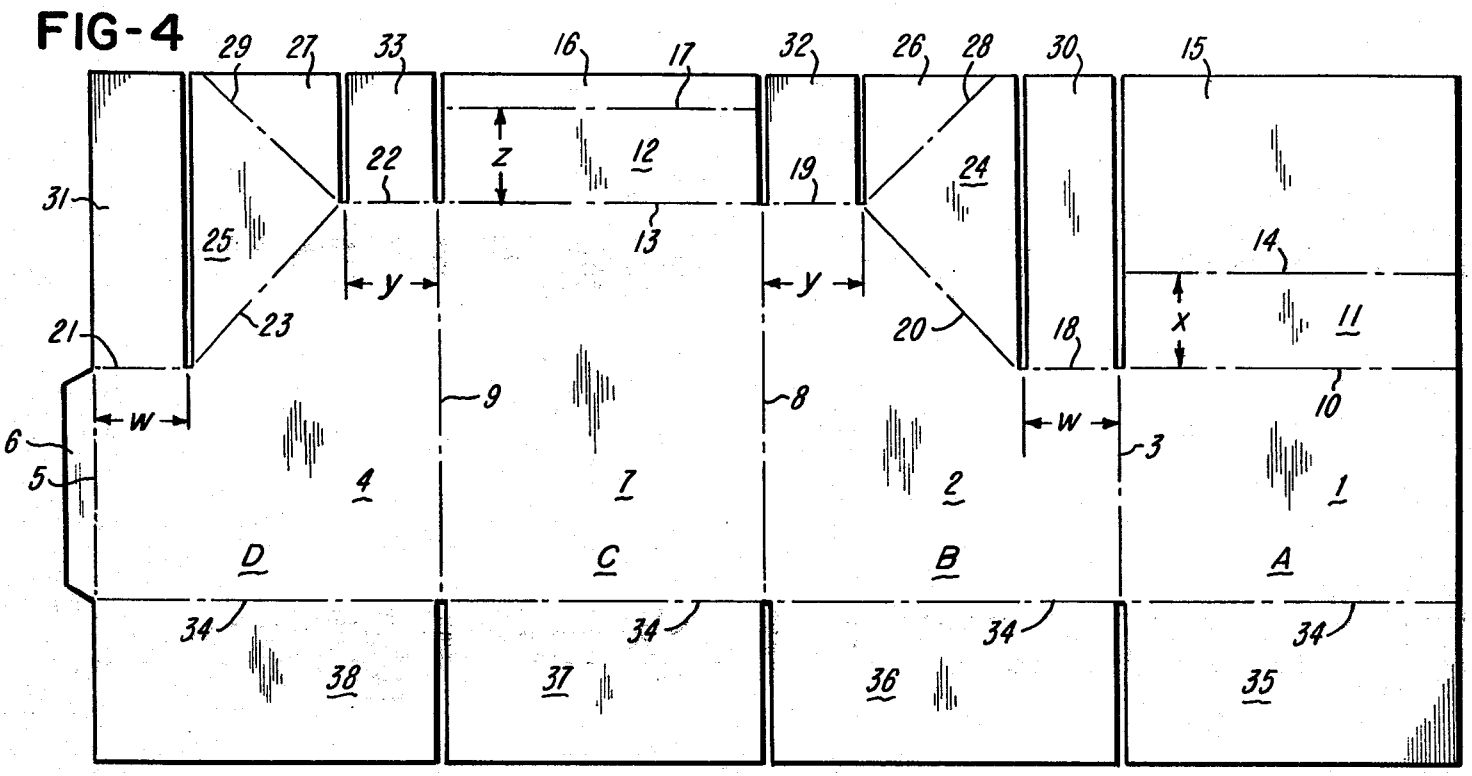
FIG. 4 is a plan view of a blank from which the container is formed.

Referring to FIG. 4, there is shown a blank from which the preferred embodiment of the container is formed. The blank is of substantially rectangular outline and is defined by spaced upper and lower longitudinal edges and spaced transverse side edges; it comprises four rectangular main sections A, B, C, and D arranged in side-by-side relation. Section A is subdivided into a series of panels comprising lower front wall 1, intermediate horizontal wall 11, and upper inclined wall 15, joined to each other, in the order named, along first and second fold lines 10 and 14, respectively. Section B is joined to lower front wall 1 along fold line 3 and provides side wall 2, reinforcing flap 30, reinforcing panel 24, stabilizing flap 26, and top wall reinforcing flap 32. In more detail, the upper edge of side wall 2 is defined by a horizontal score line 18 aligned with fold line 10, an upper score line 19, and diagonal score line 20 extending between the inner ends of score lines 18 and 19, respectively. Reinforcing flap 30 is foldably joined along horizontal score line 18 while top wall reinforcing flap 32 is foldably joined along upper horizontal score line 19. The remaining portion of blank section B, disposed between reinforcing flap 30 and top wall reinforcing flap 32 and separated therefrom by slots extending to the upper edge of the blank, provides reinforcing panel 24 foldably joined to side wall 2 along diagonal score line 20 as well as stabilizing flap 26 foldably joined to reinforcing panel 24 along diagonal fold line 28. Of course, the angular relationship between score line 20 and fold line 28 is such that the latter extends horizontally and substantially coincides with the inner edge 17 of top wall 12 when the container is assembled; in the example illustrated, fold line 28 is perpendicular with respect to diagonal score line 20. Blank section C comprises rear wall 7 joined to side wall 2 along fold line 8 and further provides top wall 12 and front flap 16 hingedly joined to rear wall 3 and top wall 12 along upper fold lines 13 and 17, respectively. Blank section D represents a mirror image of blank section B and comprises side wall 4 joined to rear wall 3 along fold line 9, reinforcing panel 25 joined to side wall 4 along diagonal score line 23, reinforcing flap 31 and top wall reinforcing flap 33 joined to side wall 4 along lower and upper horizontal score lines 21 and 22, respectively. Likewise, a stabilizing flap 27 is provided and hinged to reinforcing panel 25 along diagonal score line 29.

It will be noted that lower horizontal score lines 18 and 21, associated with reinforcing flaps 30 and 31, are aligned with foldline 10 which defines the forward edge of intermediate horizontal wall 11 in the assembled container. Likewise, upper horizontal score lines 19 and 22, associated with top wall reinforcing flaps 32 and 33, are aligned with fold line 13, the latter forming the upper edge of rear wall 3 when the container is completed. As previously indicated, these reinforcing flaps have substantially the same width as the respective associated walls; accordingly, the length of the horizontal score lines 18 and 21, identified by the letter $w$, is substantially the same as dimension $x$ designating the distance between fold lines 10 and 14 whereas dimension $y$, defining the length of upper horizontal score lines 19 and 22, corresponds to the distance $z$ between fold lines 13 and 17. Furthermore, in the preferred embodiment shown, dimensions $x$ and $z$ are substantially the same with the result that intermediate horizontal wall 11 and top wall 12 have substantially the same size.

The lower edges of the lower front wall 1, side wall 2, rear wall 3, and side wall 4 are defined by a continuous score line 34. Foldably attached thereto are bottom closure flaps 35, 36, 37 and 38 in a manner well-known in the art. Furthermore, for securing side wall 4 to the free end edge of lower front wall 1, an attachment flap 6 is provided adjacent side wall 4 and joined thereto along fold line 5.

To assemble the blank of FIG. 4 into a collapsed tubular structure, blank section D together with attachment flap 6 is swung to the right about fold line 9 and glue is applied to the exposed surface of the attachment flap. Thereafter, blank section A is folded about fold line 3 to the left so that the margin of lower front wall 1 is superimposed on attachment flap 6.

Figure 2:
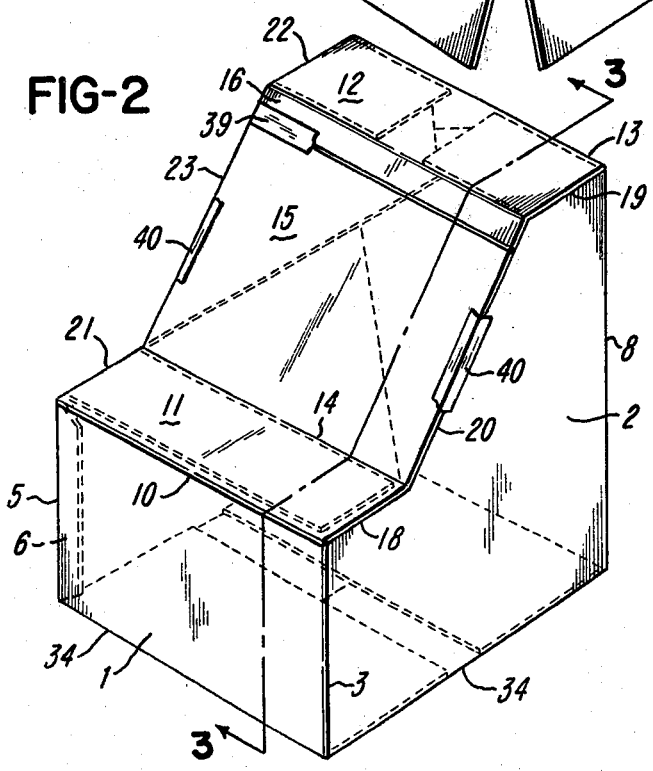
FIG. 2 is a similar view showing the completed and closed container.

To erect and load the container, I prefer to place the expanded structure over a wooden jig (not shown) and to close the front and top while the bottom closure flaps 35, 36, 37 and 38 are left depending from their associated walls. After infolding the reinforcing panels 24, 25, stabilizing flaps 26, 27, reinforcing flaps 30, 31 and top wall reinforcing flaps 32, 33 as indicated in FIG. 1, intermediate horizontal wall 11, upper inclined wall 15, as well as top wall 12 and front flap 16 are placed into the position shown in FIG. 2. Thereafter, a strip of adhesive tape 39, such as pressure sensitive adhesive tape, is placed over the abutting joint of inclined upper front wall 15 and front flap 16. If desired, strips of adhesive tape may be applied also along the stepped under edges 18, 19, 20 and 21, 22, 23 of side walls 2 and 4, respectively, as indicated at reference numeral 40, to render the container dust-proof. The partially assembled container is now removed from the jig and telescoped over the upholstered chair whereafter the bottom closure flaps 35, 36, 37 and 38 are folded into overlapping relation and secured to each other. Of course, the container could be prepared and loaded also by first closing and securing the bottom closure flaps and thereafter placing the chair into the container; still another possibility would be to wrap the blank around the chair and then to secure lower front wall 1 to side wall 4 either by means of the attachment flap or adhesive tape.

While the preferred embodiment has been shown and described in the foregoing as applied to an upholstered chair, it will be noted that the container of the present invention may be used for other articles of similar stepped cross section such as store display cases, laboratory cabinets, etc. Furthermore, it will be understood that a variety of modifications may be made within the scope of the present invention. For instance, the bottom closure flaps may be omitted if the furniture piece is supported and affixed to a platform or pallet. In this latter instance, the vertical walls of the container are secured, at the lower margins thereof, to the platform as it is well-known in the art. Moreover, the wall-forming components could be arranged on the blank so that blank section D is positioned to the right of blank section A and score line 5 coincides with and is joined to the free edge of lower front wall 1.

What I claim is:

1. A blank of substantially rectangular outline defined by spaced upper and lower longitudinal edges and spaced transverse side edges, adapted to be formed into a stepped container having a reinforced inclined upper front wall, comprising a series of rectangular blank sections including a front wall section, two side wall sections, and a rear wall section, arranged in side-by-side relation;

said front wall section comprising, in the order named, a lower front wall panel extending upwardly from said lower edge of said blank, an intermediate horizontal wall panel and an upper front wall panel, foldably joined to each other along spaced first and second longitudinal fold lines, respectively;

said rear wall section comprising a rear wall panel extending upwardly from said lower edge of said blank and having a transverse dimension substantially greater than that of said lower front wall panel, and a top wall panel joined to said rear wall panel along an upper longitudinal fold line;

each of said side wall sections comprising a side wall panel having a stepped upper edge defined by a short lower score line aligned with said first fold line and having a length corresponding to the spacing of said first and second fold lines;

a short upper score line aligned with said upper fold line and having a length corresponding to the transverse dimension of said top wall panel;

a diagonal score line interconnecting said lower and upper score lines;

each of said side wall sections including reinforcing flaps foldably joined to said lower and upper score lines, respectively, and defined by slots extending from the ends of said lower and upper score lines to said upper edge of said blank; and a reinforcing panel and a stabilizing flap disposed between said reinforcing flaps, said reinforcing panel being foldably joined to said side wall panel along said diagonal score line and said stabilizing flap being foldably joined to said reinforcing panel along a fold line perpendicular to said diagonal score line.

2. The blank of claim 1 wherein said rear wall section includes a front flap foldably joined to said top wall panel along a fold line spaced upwardly from said upper fold line.

3. The blank of claim 1, further comprising bottom closure flaps foldably joined to said blank sections along said lower edge of said blank.

4. A stepped shipping container formed from a single unitary blank, comprising a. a lower front wall;

b. a rear wall spaced from said lower front wall and having a vertical extent substantially greater than that of said lower front wall;

c. an inwardly extending intermediate horizontal wall joined to the upper edge of said lower front wall and having an inner edge spaced from said rear wall;

d. a forwardly extending horizontal top wall joined to the top edge of said rear wall and having a forward edge spaced from the plane of said lower front wall;

e. an upper inclined front wall integrally joined to said intermediate horizontal wall and extending between said inner edge of said intermediate horizontal wall and said forward edge of said top wall, respectively;

f. opposing side walls interconnecting said lower front wall and said rear wall along vertical fold lines, each of said side walls having a stepped upper edge defined by aa. an intermediate horizontal edge adjacent said intermediate horizontal wall and coextensive therewith;

bb. an upper horizontal edge adjacent said top wall and coextensive therewith; and cc. an inclined edge interconnecting said intermediate horizontal and upper horizontal edge, respectively;

g. a reinforcing panel joined to said inclined edge of each of said side walls and folded into underlying face-contacting relation with said upper inclined front wall;

h. a stabilizing flap joined to said reinforcing panel along a horizontal fold line and underlying said top wall;

i. and a top wall reinforcing flap joined to said upper horizontal edge of each of said side walls and folded into cooperating relation with said stabilizing flap.

5. The container of claim 4, further including a reinforcing flap integrally joined to said intermediate horizontal edge of each of said side walls and underlying said intermediate horizontal wall.

6. The container of claim 4 comprising a front flap joined to said forward edge of said top wall and disposed in coplanar and abutting relation with said inclined upper front wall.

7. The container of claim 4 wherein the angle of inclination between said inclined edge of said side wall and a horizontal line is from about 30° to about 60°.

8. The container of claim 4 wherein said intermediate horizontal wall and said top wall are of substantially the same size.

9. A form-fitting shipping container for a piece of furniture such as an upholstered chair of the type having a relatively low seat and a backrest, comprising a. a lower front wall having a width and height corresponding to the front end of said chair;

b. a rear wall having a width and height corresponding to the backrest of said chair;

c. an intermediate horizontal wall joined to the upper edge of said lower front wall and overlying a front portion of said chair;

d. a horizontal top wall joined to the upper edge of said rear wall and extending forwardly over the top of said backrest;

e. an inclined upper front wall joined to said intermediate horizontal wall and extending between said intermediate wall and said top wall;

f. opposing side walls interconnecting said lower front wall and said rear wall, each of said side walls having a lower horizontal edge coextensive with said intermediate horizontal wall, an upper horizontal edge coextensive with said top wall, and an inclined edge extending between said lower and upper horizontal edge;

g. reinforcing flaps joined to said lower and upper horizontal edges of each of said side walls and folded inwardly to underlie said intermediate horizontal wall and said top wall, respectively;

h. reinforcing panel joined to said inclined edge of each of said side walls and disposed in face-contacting relation with said inclined upper front wall, said reinforcing panel being of substantially triangular configuration;

said container being formed from a single unitary blank of generally rectangular outline.

* * * * *